US006502514B1

(12) United States Patent
Holler

(10) Patent No.: US 6,502,514 B1
(45) Date of Patent: Jan. 7, 2003

(54) FIREARM CARTRIDGE HAVING A PLURALITY OF IGNITION PRIMER CHAMBERS AND ASSOCIATED METHODS FOR REDUCING THE LIKELIHOOD OF MISFIRE AND COLD SHOT AND ENHANCING RAPID AND RELIABLE FIRING

(76) Inventor: Christopher A. Holler, 301 S. Orlando Ave. Suite 200, Maitland, FL (US) 32751

( * ) Notice: Subject to any disclaimer, the term of this patent is extended or adjusted under 35 U.S.C. 154(b) by 0 days.

(21) Appl. No.: 09/952,634

(22) Filed: Sep. 12, 2001

(51) Int. Cl.[7] ..... F42B 5/26

(52) U.S. Cl. ..... 102/470; 102/204; 102/443; 102/430

(58) Field of Search ..... 102/204, 473, 102/470, 438–439, 443, 220, 430

(56) References Cited

U.S. PATENT DOCUMENTS

| | | | | | |
|---|---|---|---|---|---|
| 85,730 | A | * | 1/1869 | Crocker | 102/204 |
| 643,974 | A | * | 2/1900 | Parker | 102/204 |
| 679,792 | A | * | 8/1901 | Stuart | 102/204 |
| 1,491,000 | A | | 4/1924 | Brandt et al. | |
| 2,535,624 | A | * | 12/1950 | Burney | 102/443 |
| 3,283,719 | A | | 11/1966 | Grandy | 102/40 |
| 3,857,339 | A | * | 12/1974 | Grandy | 102/430 |
| 3,948,176 | A | | 4/1976 | Koomen | 102/20 |
| 4,378,739 | A | | 4/1983 | Klein et al. | 102/204 |
| 4,522,665 | A | * | 6/1985 | Yates et al. | 102/204 |
| 4,619,200 | A | | 10/1986 | Bell | 102/275 |
| 4,765,566 | A | * | 8/1988 | Fixell et al. | 102/473 |
| 5,148,749 | A | | 9/1992 | Maes et al. | 102/204 |
| 5,992,881 | A | * | 11/1999 | Faigle | |
| 6,068,291 | A | * | 5/2000 | Lebaudy et al. | 102/217 |
| 6,095,556 | A | | 8/2000 | Bailey et al. | 280/737 |

* cited by examiner

*Primary Examiner*—Michael J. Carone
*Assistant Examiner*—Lulit Semunegus
(74) *Attorney, Agent, or Firm*—Allen, Dyer, Doppelt, Milbrath & Gilchrist, P.A.

(57) ABSTRACT

A multi-ignition cartridge and associated methods for use with a firearm are provided. The cartridge preferably includes a casing having an interior cavity which at least partially encloses at least one projectile. Chances of misfire and cold fire are substantially reduced by including in the casing a plurality of chambers. Each of the chambers preferably is in fluid communication with the cavity and containing an ignitable substance to ignite a main charge in the casing to propel the projectile from the casing. The ignitable substance in a chamber is ignited by striking a strike plate that can be positioned in contact with the casing. Related methods are provided for propelling the projectile of a firearm by simultaneously increasing pressure in multiple chambers of a cartridge casing so as to ignite in at least one chamber the ignitable substance contained in each so as to ignite a main charge that propels the projectile.

22 Claims, 2 Drawing Sheets

20
22
24
26
28
30
32
34
36
40
41
42
43
45
46
48
50
52
54
CP
3

FIREARM CARTRIDGE HAVING A PLURALITY OF IGNITION PRIMER CHAMBERS AND ASSOCIATED METHODS FOR REDUCING THE LIKELIHOOD OF MISFIRE AND COLD SHOT AND ENHANCING RAPID AND RELIABLE FIRING

FIELD OF THE INVENTION

The present invention relates to the field of firearms and, more specifically, to the field of firearm cartridges.

BACKGROUND OF THE INVENTION

A cartridge provides ammunition for a firearm. It normally includes a casing, a projectile associated with the casing, an ignitable propellant that when ignited propels the projectile away from the casing through the barrel of the firearm, and a primer that ignites the propellant. The ignitable propellant ordinarily ignites upon the application of heat as with, for example, ordinary gunpowder (i.e., potassium nitrate, wood charcoal, and sulfur in the approximate proportions of 6:1:1 by mass). The propellant responds to heat by suddenly forming hot expanding gases that causes a contained explosion that propels the projectile from the firearm. The primer normally is a percussion impact or pressure sensitive compound that ignites in response to shock or pressure. In firing, a striker or firing pin usually a small rod or hammer causes a shock and/or pressure that ignites the primer. When ignited, the primer expels hot particles or gas. The heat generated by ignition of the primer in turn ignites the propellant causing the sudden formation of hot expanding gases result in the contained explosion that propels the projectile from the firearm.

The cartridge combines into a single self-contained system each of the elements that must be included either as part of the ammunition or the firearm itself for successful firing. By contrast, each of these elements had to be separately loaded in flint-lock and percussion cap firearms which were the only available firearms up through the middle of the nineteenth century. By incorporating each of these items in a stand-alone, easily loaded module, the cartridge has made the firearm more potent and more practical. The cartridge has been perhaps the most important factor contributing to the advances in small arms technology that began in the latter half of the nineteenth century.

Notwithstanding its significant advantages, problems with the conventional firearm cartridge remain. Foremost among these is the risk that the ignitable substance forming the primer will fail. For example, a defect in the manufacture of the substance might render it inoperable before it is positioned within the cartridge casing. Even if the primer substance is free of defect and operable when first put into the cartridge, there remains the risk that it might later be rendered inoperable. For example, moisture could enter the portion of the cartridge where the primer is placed. The possibility that this might occur is higher the more harsh the conditions under which the firearm and cartridge are used such as in a wet or swampy area. Because the primer is most efficiently placed near the proximal end surface of the cartridge casing, there is a greater possibility the primer will be damaged than will the propellant, which is ordinarily ensconced in a medial portion of the casing between the projectile and the proximal end of the casing.

Because, again, the primer is positioned most efficiently near the proximal end surface of the cartridge there also is the risk that rather than moisture seeping in, the primer substance could seep out due to a small hole or other defect in the casing. Whatever, the cause, the fact remains that if the primer substance is or becomes inoperable, the cartridge will misfire or far more likely not fire at all. The later is commonly referred to as cold shot. Specifically, if the primer substance, for whatever reason, is inoperable, the primer will not ignite and, hence, neither will the propellant, thus leading to a failure of the firearm to fire.

There have been efforts to address some of the firing problems inherent in conventional firearm cartridges. For example, U.S. Pat. No. 5,148,749 to Maes et al., titled Priming Chamber For A Firearm Cartridge. Maes et al., attempts to improve the conveyance of heat from a primer chamber to a main charge (i.e., powder) in the cartridge by positioning an anvil and flash holes in the primer chamber. Maes et al., however, fails to address the problems associated with misfire as described above. U.S. Pat. No. 4,378,739 to Klein et al., titled Primer Firing Means, does attempt to enhance firing reliability, but requires the replacement of a firing pin mechanism with use of a shockwave, high-pressure gas that is propelled by a detonating chord. Thus, the Klein et al. device is unworkable in the context of a standard firearm which fires a cartridge having a casing and a projectile positioned at least partially therein and which requires detonation using a firing pin.

In an unrelated context, U.S. Pat. No. 1,491,000 to Brandt et al., titled Torpedo, suggests an improvement to the fuse used to launch a torpedo. Brandt et al. attempts to reduce the possibility of cold shot by using two primer caps. Upon detonation, each primer cap releases heat or pressure which is then conveyed along angled passageways to a central tube and onward to the end of the tube where there is positioned an ignitable substance adapted to blow out an end cap and ignite a slow burning fuse. The primer caps are ignited when struck by a multi-pronged striker that, until firing, remains spaced apart from the primer caps. The features of Brandt et al., like those of Klein et al., however, are ill-suited for adaption to a firearm. The features which may work well for a torpedo pose distinct disadvantages for the cartridge of a firearm. Among these are the specific primer cap detonator that must be used. The multi-pronged structure is more complicated and costly to manufacture, while the need to space it apart from the caps to be detonated slows down firing time. The problem of slowed firing time, moreover, is exacerbated by the fact that the device also relies on a slow burning fuse for firing.

Moreover, Brand et al. presents other features that themselves can increase the risk of cold shot. Specifically, the indirect conveyance of heat from the primer caps via angled passages that must merge into a single long tube not only further reduces firing time, but also presents the risk that particles may lodge at one of the bends of the angled passages. If the lodged particles clog the single tube, there is no alternative means of conveying the heat needed for firing. If this occurs, the result is a cold shot.

In light of these limitations on other devices, there remains a significant need for a cartridge usable with a standard firearm that provides reduced delay in detonation and enhanced reliability in firing.

SUMMARY OF THE INVENTION

With the foregoing in mind, the present invention advantageously provides a multi-ignition cartridge that has substantially reduced chances for misfire and cold shot. The multi-ignition cartridge, moreover, further provides for rapid firing by ensuring that the time lapse between impact of the firearm's firing pin of the firearm's on the multi-ignition cartridge and the firing of a projectile from the cartridge is kept to a minimum. Moreover, the multi-ignition cartridge achieves these distinct advantages while nonetheless being relatively easy and cost efficient to manufacture.

According to the present invention, the multi-ignition cartridge includes a cartridge casing and at least one projectile adapted to be positioned at least partially within the casing. The cartridge casing further includes at least two separate chambers formed in the casing. Each chamber, moreover, is in fluid communication with a separate interior cavity formed in the cartridge and in which the at least one projectile can be at least partially contained. The outer surfaces of each chamber form portions of the surface of the cartridge casing. A strike plate is positioned to contact each surface portion corresponding to each chamber. Preferably, the strike plate abuttingly contacts each surface portion.

Each separate chamber contains an ignitable substance. When the strike plate is struck by the firearm's firing pin, the strike plate rapidly compresses the outer surface portions that correspond to each chamber. The rapid compression increases the pressure in each chamber thereby igniting the ignitable substance in at least one of the chambers. Ignition creates a rapid expansion of hot gases. Because each chamber is in fluid communication with the interior cavity, the heat is conveyed to the interior cavity. The heat is sufficient to ignite a main charge positioned in the interior cavity. When the main charge ignites, it, too, causes a rapid expansion of hot cases leading to an explosion that propels the projectile away from the casing and through the barrel of the firearm.

Because the multi-ignition cartridge contains a plurality of chambers having an ignitable substance, it is only necessary that the substance in one of the chambers ignite in order to fire the cartridge. Because the strike plate is positioned to impact and compress each chamber when the strike plate is struck once in one location by a firing pin, each chamber's pressure is increased, and it is only necessary that the substance in any one of the chambers ignite to set off the reaction that propels the projectile. Accordingly, the risk of misfire or cold shot is substantially reduced. Indeed, the probability of misfire and cold shot can be reduced in proportion to the number of additional chambers added to the cartridge according to the present invention.

A further advantage of the multi-ignition cartridge lies in the fact that the single strike plate can be positioned to abuttingly contact the corresponding surfaces of each chamber. Because there is no gap between the strike plate and surface portions of the casing corresponding to each chamber, firing is more rapid. Specifically, the impact of the firing pin on the strike plate immediately compresses each chamber and increases the pressure in each thereby igniting the ignitable substance therein. Thus, the multi-ignition cartridge not only reduces the chances for misfire and cold shot, it also ensures that the rapidity with which the cartridge fires is not reduced in order to be made more reliable.

Moreover, firing by impacting the strike plate is achieved even though the strike plate need only contact portions of each outer surface of the chambers containing the primer. Specifically, the surface portions can be arrayed on each side of a point substantially centered on the proximal end of the casing, preferably at equal distances from the center point. The strike plate preferably, then, preferably is formed to have a rectangular body that contacts only a part of each surface portion. More preferably, the surface portions lie in a single plane against which the strike plate is positioned as described above. This not only provides the advantages related to rapid firing as already described, but also makes the multi-ignition cartridge easier and more efficient to manufacturer, especially in terms of materials costs.

The rapidity with which firing is achieved is further enhanced through the means by which heat is conveyed from each chamber to the interior cavity. Specifically, the heat is preferably conveyed via direct, substantially linear passages positioned between the interior cavity and each corresponding chamber. Because heat flow is direct rather than indirect as in other devices, the time lapse between ignition of the ignitable substance in at least one chamber and the ignition of the main charge in the interior cavity is accordingly kept to a minimum.

The present invention further provides a method of propelling a projectile from a cartridge casing that is both rapid and more reliable. Specifically, firing is done by simultaneously increasing the pressure within a plurality of separate chambers formed in the casing and igniting a preselected ignitable substance positioned within at least one of the chambers. Upon ignition, the heat generated is conveyed to a bore formed in the casing to thereby ignite a combustible material positioned in the bore, the resulting contained explosion thereby propelling a projectile positioned at least partially within the bore away from the casing and through the barrel of the firearm. Accordingly, firing time is rapid in that heat is conveyed directly, while firing is more reliable in that the ignitable substance in only one of the separate chambers need ignite in order to propel the projectile from the cartridge casing.

A related method for enhancing firing and reducing the chances of misfire and cold shot in a firearm includes striking a strike plate of a cartridge, in which the strike plate has a substantially flat inner surface such that, the substantially flat surface of the plate then simultaneously strikes outer surface portions of at least two chambers in each of which is positioned an ignitable substance. The ignitable substance in at least one chamber is thereby ignited resulting in the generation of heat in the at least one chamber. Further, heat generated by the ignition of the ignitable substance is conveyed directly to a substantially hollow bore containing another ignitable substance and a projectile. When the second ignitable substance ignites, the ensuing explosion propels the projectile away from the cartridge and through the barrel of the firearm. Thus, the method aspects of the present invention, like those of the apparatus already described, reduce delay in detonation and enhance reliability in firing the cartridge in any type of firearm.

BRIEF DESCRIPTION OF THE DRAWINGS

Some of the features, advantages, and benefits of the present invention having been stated, others will become apparent as the description proceeds when taken in conjunction with the accompanying drawings in which.

DETAILED DESCRIPTION OF THE PREFERRED EMBODIMENTS

The present invention will now be described more fully hereinafter with reference to the accompanying drawings which illustrate preferred embodiments of the invention. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, the prime notation, if used, indicates similar elements in alternative embodiments.

Figures 1, 2, 3:
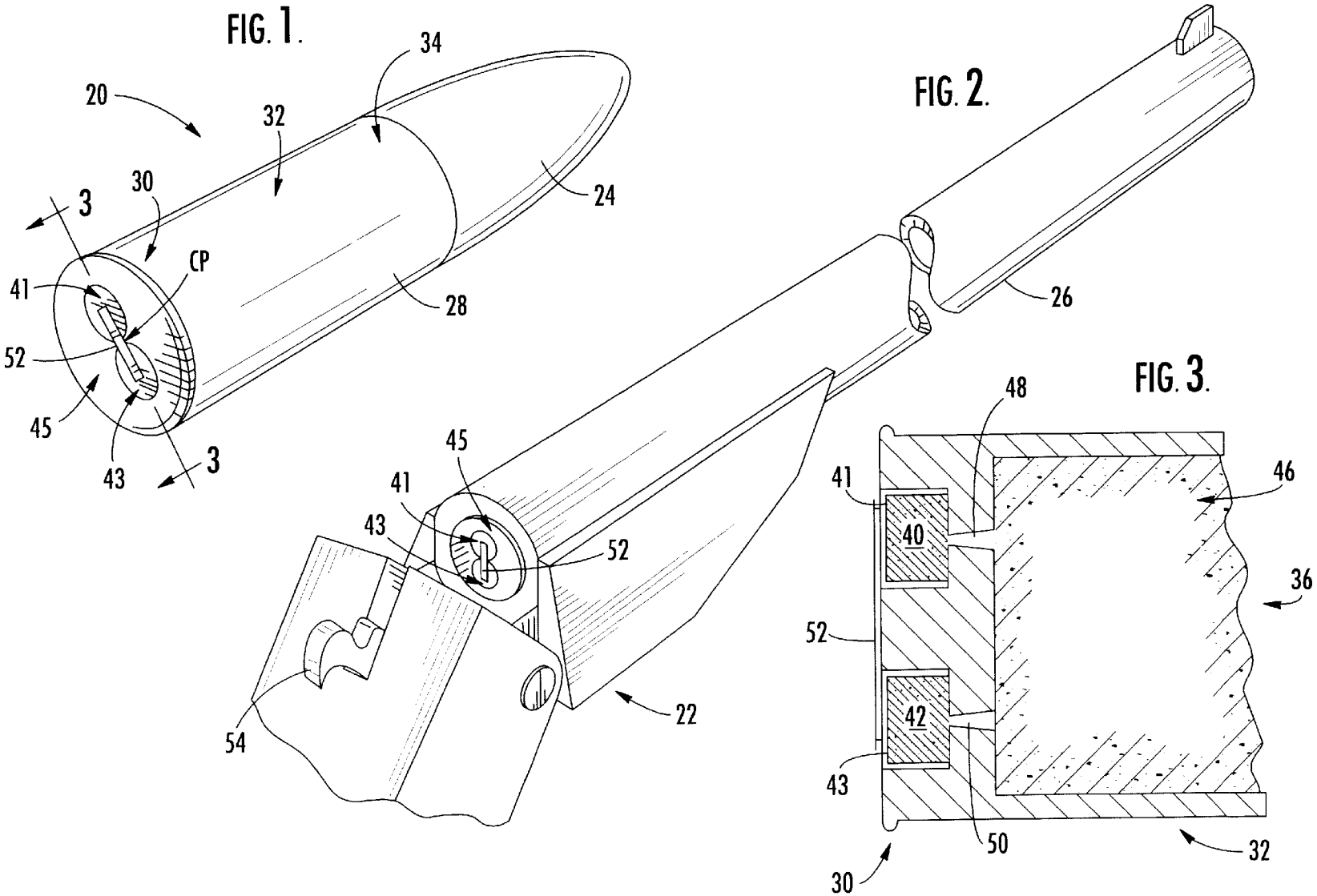
FIG. 1 is a perspective view of a multi-ignition cartridge according to the present invention.
FIG. 2 is a fragmentary perspective view of a multi-ignition cartridge positioned within a firearm according to the present invention according to the present invention.
FIG. 3 is an enlarged fragmentary sectional view taken along line 3—3 of FIG. 1 of a multi-ignition cartridge according to the present invention.

FIG. 1 illustrates a multi-ignition cartridge 20 for use with a firearm according to the present invention. FIG. 2 illustrates use of the multi-ignition cartridge 20 in a single-barrel breakaway shotgun 22. The multi-ignition cartridge 20, however, can be used with any type of firearm. As explained herein, the advantages provided by the multi-ignition cartridge 20 pertain equally to all other types of firearms such single-action and double-action pistols, automatic and breech or bolt loaded rifles, and single-shot or multi-shot shotguns, each of which will be familiar to those skilled in the art. As illustrated in FIG. 1, the cartridge 20 includes at least one projectile 24 adapted to be fired through a barrel 26 of the firearm 22 and a cartridge casing 28 that, preferably, extends substantially around at least a portion of the projectile 24.

More specifically, the cartridge casing 28 according to the present invention is formed to have a substantially solid proximal end portion 30. Connected to the proximal end portion 30 of the casing 28 and extending outwardly therefrom, is a medial portion 32. A distal end portion 34 is connected to the medial portion 32 of the casing 28 and extends outwardly therefrom. A bore defining an interior cavity 36 extends through the distal end portion 34 and medial portion 32 of the casing 28 and is adjacent the proximal end portion 30 thereby forming the interior cavity 36. The interior cavity 36 preferably is adapted so that the at least one projectile 24 is or can be positioned therein.

The interior cavity 36, moreover, is preferably adapted to permit a first preselected ignitable substance 38 defining a main explosive charge to be positioned within the interior cavity 36 between the at least one projectile 24 and the proximal end portion 30 of the casing 28. When the first preselected ignitable substance 38 ignites the resulting rapid build up of pressure propels the at least one projectile 24 away from the casing 28 and through the barrel of the firearm 22 as will be readily understood by those skilled in the art.

Preferably, a plurality of chambers, including at least a first chamber 40 and a second chamber 42 are formed in the cartridge casing 28. As illustrated in FIGS. 3 and 4*a*–4*c* the at least first chamber 40 and second chamber 42 are preferably formed in the proximal end portion 30 of the cartridge casing 28. As perhaps best illustrated in FIGS. 1 and 2, the first chamber 40 has an outer surface 41 that defines a first surface portion 41 of the outer surface 45 of the proximal end portion 30 of the cartridge casing 28. The second chamber 42 also has an outer surface, which defines a second surface portion 43 of the outer surface 45 of the proximal end portion 30 of the cartridge casing 28. Preferably, the outer surface portions 41, 43 of the first and second chambers 40, 42 lie in the same plane as the remaining portions of the outer surface 45 of the cartridge casing 28 so as to form a flat surface. (See FIG. 3.)

Figure 4A:
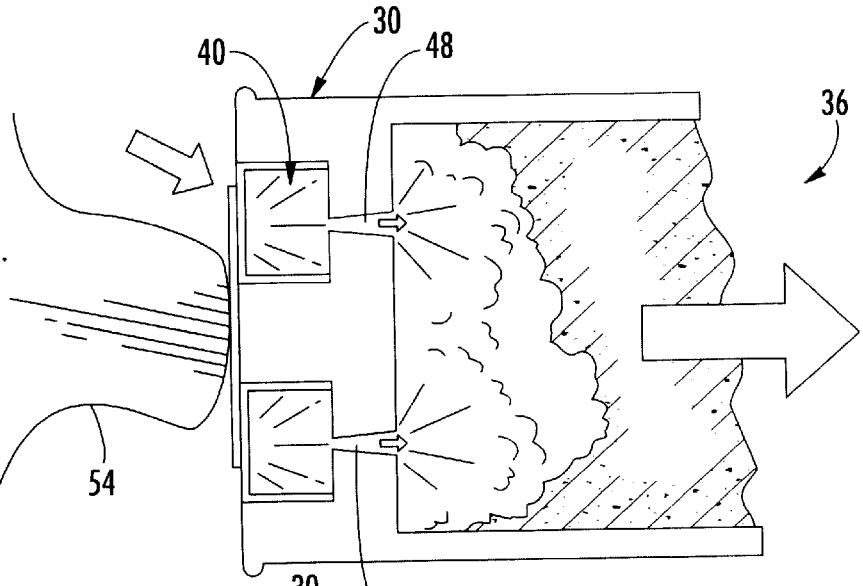
FIG. 4A is an enlarged fragmentary sectional view of a multi-ignition cartridge in which the ignitable substance in both of two chambers successfully ignites to fire a firearm according to the present invention.
Figure 4B:
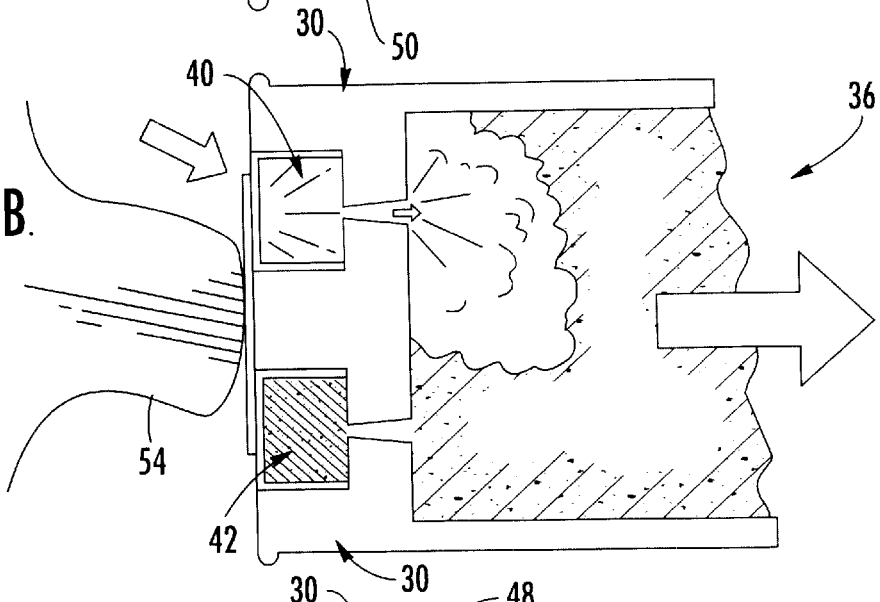
FIG. 4B is an enlarged fragmentary sectional view of a multi-ignition cartridge in which the ignitable substance in which one of two chambers successfully ignites to fire a firearm according to the present invention.
Figure 4C:
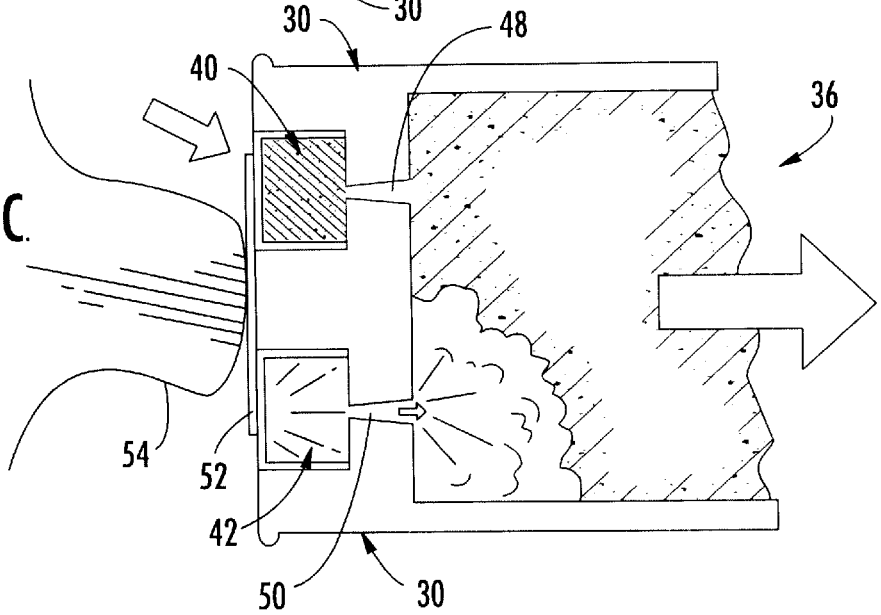
FIG. 4C is an enlarged fragmentary sectional view of a multi-ignition cartridge in which the ignitable substance in which the other of two chambers successfully ignites to fire a firearm according to the present invention.

As further shown in FIG. 3, each of the chambers 40,42 formed in the proximal end portion 30 of the cartridge casing 28 is preferably in fluid communication with the interior cavity 36 of the cartridge casing 28. Moreover, each of the chambers 40,42 is adapted to position therein a second preselected ignitable substance 46. When ignited in one or more of the at least two chambers 40,42, the second preselected ignitable substance 46 generates heat, or more specifically, exploding gas at elevated temperatures (see FIGS. 3 and 4A–4C). FIGS. 4A–4C explicitly illustrate the ensuing result. The exploding gas as it expands exists at least one of the chambers 40,42 and enters the interior cavity 36 with which each of the chambers is in fluid communication. The result is that heat and/or pressure are conveyed to the interior cavity 36 from the at least one chamber 40,42. As will be readily understood by those skilled in the art, the heat and/or pressure so generated in at least one of the chambers 40,42 and conveyed to the interior cavity 36 ignites the first preselected substance positioned in the interior cavity 36. When the first preselected ignitable substance 38 ignites, the resulting explosion of expanding gas forcefully propels the projectile 24 away from the cartridge casing 28 and through the barrel 26 of the firearm 22.

The provision not merely of one but a plurality of chambers 40, 42 formed in the proximal end portion 30 of the casing 28 substantially reduces the likelihood of misfire or cold fire according to the present invention. Specifically, each chamber 40, 42 of the cartridge casing 28 preferably is separate from each of the at least one other chambers. To achieve firing, therefore, it is only necessary that the second preselected ignitable substance 46 in one of the multiple chambers 40, 42 ignite. If the second preselected ignitable substance 46 in all but one of the chambers fails to ignite, firing will still be achieved because ignition of the substance 46 in the one remaining chamber generates enough heat and/or pressure to ignite the main charge in the interior cavity. It is the first preselected ignitable substance 38 that provides the main charge that propels the projectile 24 away from the casing 28 and through the barrel 26 of the firearm 22.

FIG. 4A specifically, illustrates successful firing of the multi-ignition cartridge 20 in the event that the second preselected ignitable substance 46 ignites in both of the at least two chambers 40,42. FIG. 4B illustrates successful firing of the multi-ignition cartridge 20 if the second preselected ignitable substance 46 ignites in only one of the at least two chambers, and FIG. 4C illustrates successful firing if the second preselected ignitable substance 46 ignites only in the other chamber.

Accordingly, firing is achieved even if the second preselected ignitable substance 46 ignites successfully in only one of the chambers. The corresponding result is that the chances of misfire or cold shot is substantially reduced, as already noted. Indeed, the probability of misfire or cold shot can be further reduced simply by adding additional separate chambers to house the second preselected ignitable substance 46. The advantages provided by such a multi-ignition cartridge 20 can not be overstated. Misfire can affect a sportsman's chances of success in competitive shooting matches and in the hunting arena. Far more importantly, cold shot can be deadly when a law enforcement officer or potential crime victim is relying on a firearm for protection in a life-or-death situation.

A further distinct advantage lies in the manner in which heat and/or pressure is conveyed according to the present invention. Preferably, as explicitly illustrated in FIGS. 3 and 4A–4C, fluid communication between each of the multiple chambers 40, 42 and the interior cavity 36 is achieved by distinct apertures 48, 50 defining a plurality of separate passageways between the interior cavity 36 and each of the at least two chambers 40, 42. This further reduces changes of misfire and cold fire. Specifically, if one or more of the at least two passageways 48, 50 should be inoperative for any reason, fire will still be achieved provided one passageway remains operative and the second preselected ignitable substance 46 in the corresponding chamber successfully ignites.

Still additionally, according to the present invention, further advantages are achieved according to the manner in which heat and/or pressure is conveyed to the interior cavity 36 from at least one of the multiple chambers 40, 42 following ignition of the second preselected ignitable substance 46. Specifically, as illustrated in FIGS. 3 and **4*a*–4*c*, heat and/or pressure is conveyed to the interior cavity 36 from each chamber 40, 42 via separate passageways 48, 50 that are substantially linear. Specifically, by substantially linear conveyance, gas is conveyed in substantially a straight line from the point of explosion through at least one of the plurality of apertures or passageways 48, 50 directly to the interior cavity 36. In the split-second sequence of firing, this direct conveyance enhances the rapidity with which the ignition of the second preselected ignitable substance 46 in at least one chamber 40, 42 ignites the first preselected ignitable substance 38 defining a main charge so as to fire the projectile 24 from the firearm 22**.

As FIG. 3 also illustrates, the multi-ignition cartridge 20 preferably further includes a strike plate 52 positioned to contact the first and second surface portions 41, 43 of the outer surface 44 cartridge casing 28, which as described above correspond respectively to the outer surfaces of the first chamber 40 and the second chamber 42. Striking the strike plate 52, preferably with a firing pin 54 associated with the firearm 22, causes the strike plate 52 to impact the first and second surface portions 41, 43 thereby compressing each and causing an increase in pressure in the corresponding chambers 40, 42. This causes the ignitable substance 46 (i.e., the second preselected ignitable substance) in at least one of the chambers 40, 42 to ignite.

Ignition causes a sudden formation of hot expanding gases. Because each chamber is in fluid communication with the interior cavity 36, the heat generated in at least one of the chambers is rapidly conveyed to the interior cavity. The conveyed heat ignites the main charge 38 (i.e., the first preselected ignitable substance) which is positioned in the interior cavity 36, being positioned substantially between the proximal end portion 36 of the casing 28 and the projectile 24 positioned at least partially within the cartridge casing 28. The first preselected ignitable substance 38 can be ordinary gunpowder composed of potassium nitrate, wood charcoal, and sulfur in the approximate proportions of 6:1:1 by mass. When heat is supplied to the gunpowder, the following chemical reaction occurs: $2KNO_3(s)+S(s)+3C(s) \rightarrow K_2S(s)+N_2(g)+3CO_2(g)$. As will be readily understood by those skilled in the art, the reaction produces a sudden formation of hot expanding gases leading to a forceful explosion that propels the projectile 24 away from the cartridge casing 28 and through the barrel 26 of the associated firearm 22.

Preferably, the strike plate 52 is positioned to abuttingly contact the first and second surface portions 41, 43 of the cartridge casing 28. This continuous contact provides a further distinct advantage of more rapid firing. Because there is no gap between the strike plate 54 and the first and second surface portions 41, 43, the impact of the firing pin 54 on the strike plate 52 causes the strike plate 52 to immediately compress the respective chambers 40, 42 of the cartridge casing 28 so as to ignite the second preselected ignitable substance 46 therein and set off the reaction that fires the projectile 24. The abuttingly contacting strike plate 52 can be positioned within a recess formed in the outer surface 45 of the cartridge casing 28. Preferably, however, the outer surface 45 of the cartridge casing 28 is planar, and the strike plate 52 is formed to have a substantially flat surface so that the strike plate can be positioned flush or nearly so against the outer surface 45 of the cartridge casing 28. This preferred positioning not only makes the firing of the multi-ignition cartridge 20 more rapid, but also makes its manufacture easier and more efficient.

Preferably, the first and second surface portions 41, 43 of the cartridge casing 28 corresponding respectively to outer surface portions of the first and second chambers 40, 42 formed therein are each aligned on opposite sides of an imaginary center point CP positioned substantially in the center of the outer surface 45 of the proximal end portion 30 of the cartridge casing 28. More preferably, the first and second outer surface portions 41,43 are each positioned at substantially equal distances from the center point CP. If the multi-ignition cartridge 20 contains two chambers 40, 42 then preferably the strike plate 52 is a substantially rectangular body having a first end positioned to contact less than half of the surface area of the first surface portion 41 and a second end positioned to contact less than half of the surface area of the second surface portion 43. This also contributes to making the multi-ignition cartridge 20 more efficient to operate as well as easier and more efficient to manufacture.

Relatedly, the present invention also provides various methods for enhancing firing speed and reliability of a firearm 22. Specifically, the present invention presents a method of propelling a projectile 24 from a cartridge casing 28 by simultaneously increasing the pressure within a plurality of separate chambers 40, 42 formed in a cartridge casing and having an ignitable substance 46 contained therein. The method further entails igniting the ignitable substance 46 positioned within at least one of the chambers 40, 42 and conveying the heat generated as a result of the ignition of the ignitable substance 46 to a bore defining an interior cavity 36 formed in the cartridge casing 28 to thereby ignite another ignitable substance 38 positioned in the interior cavity 36 so as to propel the projectile 24 positioned at least partially therein away from the cartridge casing 28.

The method more specifically can entail simultaneously increasing the pressure within the plurality of chambers 40, 42 by striking a striking plate 52 that contacts at least part of the outer surfaces 41, 43 of each chamber 40, 42. Moreover, in conveying the heat generated as a result of the ignition of the ignitable substance 46, the method entails conveying the heat in a linear direction from the at least one chamber 40, 42 in which the substance 46 is ignited to the interior cavity 36 within which the other ignitable substance 38 is positioned and within which the projectile 24 is at least partially positioned.

Another method aspect of the present invention provides for enhancing firing and reducing the chances of misfire and cold shot in a firearm 22. According to the method, firing is initiated by striking a strike plate 52 of a cartridge 20, the strike plate 52 having a substantially flat inner surface, so as to cause the flat surface to simultaneously strike outer surface portions 41, 43 of at least two chambers 40,42 when an ignitable substance is contained therein. Further, according to the method, heat generated by the ignition of the ignitable substance 46 is conveyed to a substantially hollow bore or cavity 36 containing another ignitable substance 38 and a projectile 24 so as to ignite the other ignitable substance 38 and propel the projectile 24 away from the firearm 22. This thereby enhances the firing time of the cartridge 20.

Further, according to the present invention, the method further entails contacting the outer surface portions 41, 43 of the at least two chambers 40, 42 with the strike plate 52 prior to striking the strike plate 52 so that the strike plate is in continuous contact therewith until the cartridge is fired. Moreover, the heat generated by ignition in at least one chamber 40, 42 is preferably conveyed, according to the present invention, in a substantially linear direction to the the interior cavity 36 in response to the strike plate striking the outer surfaces of the chambers. This further enhances the firing time of the cartridge 20.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as defined in the appended claims.

What is claimed is:

1. A multi-ignition cartridge for use with a firearm to enhance the firing thereof and reduce the chances of misfire, the cartridge comprising:

at least one projectile adapted to be fired through a barrel of the firearm;

a cartridge casing having a substantially solid proximal end portion, a medial portion connected to the proximal end portion and extending outwardly therefrom, a distal end portion connected to the medial portion and extending outwardly therefrom, a bore extending through the distal end and medial portions and adjacent the proximal end portion to thereby form an interior cavity having at least a portion of the at least one projectile positioned therein, and a first preselected ignitable substance defining a main explosive charge positioned within the interior cavity between the at least one projectile and the proximal end portion of the casing to propel the projectile through the barrel of and from the firearm when ignited;

first and second chambers formed in the proximal end portion of the cartridge casing, the first chamber having an outer surface defining a first surface portion of the outer surface of the proximal end portion of the cartridge casing, the second chamber having an outer surface defining a second surface portion of the outer surface of the proximal end portion of the cartridge casing, and each chamber being in fluid communication with the interior cavity and having a second preselected ignitable substance positioned therein to ignite the main explosive charge when the second preselected substance in at least one of the chambers is ignited; and a strike plate abuttingly contacting the first and second surface portions to thereby ignite the second preselected ignitable substance in at least one of the two chambers when the strike plate is struck by a firing pin associated with the firearm.

2. A multi-ignition cartridge as defined in claim 1, further comprising a first aperture extending from the first chamber to the interior cavity and a second aperture extending from the second chamber to the interior cavity, each aperture defining a separate passageway to convey heat generated in the corresponding chamber in response to the ignition of the second preselected ignitable substance therein from the corresponding chamber to the interior cavity to thereby ignite the main charge.

3. A multi-ignition cartridge as defined in claim 2, wherein at least one of the first and second apertures defines a substantially linear passageway such that the heat generated in the corresponding chamber in response to the ignition of the second preselected ignitable substance therein is conveyed directly to the interior cavity to thereby ignite the main charge.

4. A multi-ignition cartridge as defined in claim 3, wherein the first aperture and the second aperture each forms a substantially linear passageway to convey directly to the interior cavity heat generated by the ignition of the second preselected ignitable substance in at least one of the two chambers when the strike plate is struck by the firing pin associated with the firearm.

5. A multi-ignition cartridge as defined in claim 1, wherein the first and second surface portions of the first and second chambers respectively are aligned on opposite sides of an imaginary center point positioned substantially in the center of the outer surface of the proximal end portion of the cartridge casing, wherein the first and second outer surface portions are positioned at substantially equal distances from the center point, and wherein the strike plate comprises a substantially rectangular body having a first end positioned to contact less than half of the surface area of the first surface portion and a second end positioned to contact less than half of the surface area of the second surface.

6. A multi-ignition cartridge as defined in claim 5, wherein the strike plate contacts a first imaginary point at the center of the first surface portion and a second imaginary point at the center of the second surface portion to thereby enhance firing of the firearm and reduce the chances of misfire when the firing pin strikes the strike plate.

7. A multi-ignition cartridge for use with a firearm to enhance the firing thereof and reduce the chances of misfire, the cartridge comprising:

at least one projectile adapted to be fired through a barrel of the firearm;

a cartridge casing having a substantially solid proximal end portion, a medial portion connected to the proximal end portion and extending outwardly therefrom, a distal end portion connected to the medial portion and extending outwardly therefrom, a bore extending through the distal end and medial portions and adjacent the proximal end portion to thereby form an interior cavity having at least a portion of the at least one projectile positioned therein, and a first preselected ignitable substance defining a main explosive charge positioned within the interior cavity between the at least one projectile and the proximal end portion of the casing to propel the projectile through the barrel of and from the firearm when ignited;

first and second chambers formed in the proximal end portion of the cartridge casing, the first chamber having an outer surface defining a first surface portion of the outer surface of the proximal end portion of the cartridge casing, the second chamber having an outer surface defining a second surface portion of the outer surface of the proximal end portion of the cartridge casing, each chamber having a second preselected ignitable substance positioned therein to ignite the main explosive charge when the second preselected substance in at least one of the chambers is ignited;

first and second apertures defining separate passageways extending between the first and second chambers respectively to the interior cavity to thereby convey heat from the first and second chambers to the interior cavity when the second preselected substance is ignited in at least one of the chambers, the first aperture connected to the first chamber and the interior cavity, and the second aperture connected to the second chamber and the interior cavity; and a strike plate positioned to contact the first surface portion and the second surface portion to ignite the second preselected ignitable substance in at least one of the two chambers when the strike plate is struck by a firing pin associated with the firearm.

8. A multi-ignition cartridge as defined in claim 7, wherein at least one of the first and second apertures defines a substantially linear passageway such that the generated in the corresponding chamber in response to the ignition of the second preselected ignitable substance therein is conveyed directly to the interior cavity to thereby ignite the main charge.

9. A multi-ignition cartridge as defined in claim 8, wherein the first aperture and the second aperture each forms a substantially linear passageway to convey directly to the interior cavity heat generated by the ignition of the second preselected ignitable substance in at least one of the two chambers when the strike plate is struck by the firing pin associated with the firearm.

10. A multi-ignition cartridge as defined in claim 7, wherein the first and second surface portions of the first and second chambers respectively are aligned on opposite sides of an imaginary center point positioned substantially in the center of the outer surface of the proximal end portion of the cartridge casing, wherein the first and second outer surface portions are positioned at substantially equal distances from the center point, and wherein the strike plate comprises a substantially rectangular body having a first end positioned to contact less than half of the surface area of the first surface portion and a second end positioned to contact less than half of the surface area of the second surface.

11. A multi-ignition cartridge as defined in claim 10, wherein the strike plate contacts a first imaginary point at the center of the first surface portion and a second imaginary point at the center of the second surface portion to thereby enhance firing of the firearm and reduce the chances of misfire when the firing pin strikes the strike plate.

12. A multi-ignition cartridge casing comprising:

a substantially solid proximal end portion;

a medial portion connected to the proximal end portion and extending outwardly therefrom;

a distal end portion connected to the medial portion and extending outwardly therefrom;

a bore extending through the distal end and medial portions and adjacent the proximal end portion to thereby form an interior cavity adapted to receive and extend at least partially around at least one projectile and to house a first preselected ignitable substance defining a main explosive charge positioned between the proximal end portion and the at least one projectile extending at least partially therein;

first and second chambers formed in the proximal end portion of the cartridge casing, the first chamber having an outer surface defining a first surface portion of the outer surface of the proximal end portion of the cartridge casing, the second chamber having an outer surface defining a second surface portion of the outer surface of the proximal end portion of the cartridge casing, and each chamber being in fluid communication with the interior cavity and adapted to house a second preselected ignitable substance therein to ignite the main explosive charge when the second preselected substance in at least one of the chambers is ignited; and a strike plate abuttingly contacting the first and second surface portions to thereby ignite the second preselected ignitable substance in at least one of the two chambers when the strike plate is struck by a firing pin associated with the firearm.

13. A multi-ignition cartridge casing as defined in claim 12, further comprising a first aperture extending from the first chamber to the interior cavity and a second aperture extending from the second chamber to the interior cavity, each aperture defining a separate passageway to convey heat generated in the corresponding chamber in response to the ignition of the second preselected ignitable substance therein from the corresponding chamber to the interior cavity to thereby ignite the main charge.

14. A multi-ignition cartridge casing as defined in claim 13, wherein at least one of the first and second apertures defines a substantially linear passageway such that the heat generated in the corresponding chamber in response to the ignition of the second preselected ignitable substance therein is conveyed directly to the interior cavity to thereby ignite the main charge.

15. A multi-ignition cartridge casing as defined in claim 14, wherein the first aperture and the second aperture each forms a substantially linear passageway to convey directly to the interior cavity heat generated by the ignition of the second preselected ignitable substance in at least one of the two chambers when the strike plate is struck by the firing pin associated with the firearm.

16. A cartridge casing as defined in claim 12, wherein the first and second surface portions of the first and second chambers respectively are aligned on opposite sides of an imaginary center point positioned substantially in the center of the outer surface of the proximal end portion of the cartridge casing, wherein the first and second outer surface portions are positioned at substantially equal distances from the center point, and wherein the strike plate comprises a substantially rectangular body having a first end positioned to contact less than half of the surface area of the first surface portion and a second end positioned to contact less than half of the surface area of the second surface.

17. A cartridge casing as defined in claim 16, wherein the strike plate contacts a first imaginary point at the center of the first surface portion and a second imaginary point at the center of the second surface portion to thereby enhance firing of the firearm and reduce the chances of misfire when the firing pin strikes the strike plate.

18. A cartridge casing comprising:

a substantially solid proximal end portion;

a medial portion connected to the proximal end portion and extending outwardly therefrom;

a distal end portion connected to the medial portion and extending outwardly therefrom;

a bore extending through the distal end and medial portions and adjacent the proximal end portion to thereby form an interior cavity adapted to receive and extend at least partially around at least one projectile and to house a first preselected ignitable substance defining a main explosive charge positioned between the proximal end portion and the at least one projectile extending at least partially therein;

first and second chambers formed in the proximal end portion of the cartridge casing, the first chamber having an outer surface defining a first surface portion of the outer surface of the proximal end portion of the cartridge casing, the second chamber having an outer surface defining a second surface portion of the outer surface of the proximal end portion of the cartridge casing, and each chamber being adapted to house a second preselected ignitable substance therein to ignite the main explosive charge when the second preselected substance in at least one of the chambers is ignited;

first and second apertures defining separate passageways extending between the first and second chambers respectively to the interior cavity to thereby convey heat from the first and second chambers to the interior cavity when the second preselected substance is ignited in at least one of the chambers, the first aperture connected to the first chamber and the interior cavity, and the second aperture connected to the second chamber and the interior cavity; and a strike plate positioned to contact the first surface portion and the second surface portion to ignite the second preselected ignitable substance in at least one of the two chambers when the strike plate is struck by a firing pin associated with the firearm.

19. A multi-ignition cartridge as defined in claim 18, wherein at least one of the first and second apertures defines a substantially linear passageway such that the generated in the corresponding chamber in response to the ignition of the second preselected ignitable substance therein is conveyed directly to the interior cavity to thereby ignite the main charge.

20. A multi-ignition cartridge as defined in claim 19, wherein the first aperture and the second aperture each forms a substantially linear passageway to convey directly to the interior cavity heat generated by the ignition of the second preselected ignitable substance in at least one of the two chambers when the strike plate is struck by the firing pin associated with the firearm.

21. A multi-ignition cartridge as defined in claim 18, wherein the first and second surface portions of the first and second chambers respectively are aligned on opposite sides of an imaginary center point positioned substantially in the center of the outer surface of the proximal end portion of the cartridge casing, wherein the first and second outer surface portions are positioned at substantially equal distances from the center point, and wherein the strike plate comprises a substantially rectangular body having a first end positioned to contact less than half of the surface area of the first surface portion and a second end positioned to contact less than half of the surface area of the second surface.

22. A multi-ignition cartridge as defined in claim 21, wherein the strike plate contacts a first imaginary point at the center of the first surface portion and a second imaginary point at the center of the second surface portion to thereby enhance firing of the firearm and reduce the chances of misfire when the firing pin strikes the strike plate.

* * * * *